US010283092B2

(12) United States Patent
Du

(10) Patent No.: US 10,283,092 B2
(45) **Date of Patent: *May 7, 2019**

(54) IMAGE DISPLAY CONTROL METHODS AND APPARATUS, AND DISPLAY DEVICES

(71) Applicant: BEIJING ZHIGU RUI TUO TECH CO., LTD., Beijing (CN)

(72) Inventor: Lin Du, Beijing (CN)

(73) Assignee: BEIJING ZHIGU RUI TUO TECH CO., LTD., Beijing (CN)

( * ) Notice: Subject to any disclaimer, the term of this patent is extended or adjusted under 35 U.S.C. 154(b) by 101 days.

This patent is subject to a terminal disclaimer.

(21) Appl. No.: 15/525,503

(22) PCT Filed: Oct. 10, 2015

(86) PCT No.: PCT/CN2015/091624

§ 371 (c)(1),
(2) Date: May 9, 2017

(87) PCT Pub. No.: WO2016/074549

PCT Pub. Date: May 19, 2016

(65) Prior Publication Data

US 2017/0337904 A1 Nov. 23, 2017

(30) Foreign Application Priority Data

Nov. 14, 2014 (CN) ..... 2014 1 0645927

(51) Int. Cl.
*G09G 5/391* (2006.01)
*G09G 3/3225* (2016.01)
*G09G 3/32* (2016.01)

(52) U.S. Cl.
CPC ..... *G09G 5/391* (2013.01); *G09G 3/32* (2013.01); *G09G 3/3225* (2013.01);
(Continued)

(58) Field of Classification Search
CPC combination set(s) only.
See application file for complete search history.

(56) References Cited

U.S. PATENT DOCUMENTS

2008/0151089 A1 6/2008 Street et al.
2008/0181089 A1 7/2008 Ikeda et al.
(Continued)

FOREIGN PATENT DOCUMENTS

CN 101593469 12/2009
CN 104464620 3/2015
(Continued)

OTHER PUBLICATIONS

International Search Report and Written Opinion for Application No. PCT/CN2015/091624, dated Dec. 21, 2015, 9 pages.
(Continued)

*Primary Examiner* — Jennifer Mehmood
*Assistant Examiner* — Deeprose Subedi
(74) *Attorney, Agent, or Firm* — Sheppard Mullin Richter & Hampton LLP

(57) ABSTRACT

Embodiments of the present application provide various image display control methods and apparatus, and various display devices. One of the image display control methods comprises: acquiring target pixel density distribution information displayed by an image; adjusting display pixel density distribution of a display according to the target pixel density distribution information; and displaying the image according to the adjusted display. The technical solutions provided in the embodiments of the present application can fully use overall display pixels of a display to differently present display definition of different regions in an image and improve actual usage of the display pixels, which can better meet diversified application needs of a user.

24 Claims, 14 Drawing Sheets

(52) U.S. Cl.
CPC ..... *G09G 2300/0469* (2013.01); *G09G 2340/0407* (2013.01); *G09G 2354/00* (2013.01)

(56) References Cited

U.S. PATENT DOCUMENTS

| | | | | |
|---|---|---|---|---|
| 2012/0188245 | A1 | 7/2012 | Hyatt | |
| 2013/0027581 | A1 | 1/2013 | Price et al. | |
| 2013/0063492 | A1 | 3/2013 | Washington et al. | |
| 2013/0278486 | A1* | 10/2013 | Duerksen | G09G 3/34 345/55 |
| 2014/0232722 | A1 | 8/2014 | Deluca | |
| 2014/0313393 | A1* | 10/2014 | Kinoshita | H04N 5/23212 348/341 |

FOREIGN PATENT DOCUMENTS

| | | |
|---|---|---|
| JP | H08237636 | 9/1996 |
| JP | 2006-129411 | 5/2006 |

OTHER PUBLICATIONS

Bar-Cohen, Y., "Electroactive polymers for refreshable Braille displays," SPIE Newsroom, 2009, 3 pages.

Choi et al., "A Spatial-Temporal Multi-Resolution CMOS Image Sensor with Adaptive Frame Rates for Moving Objects in the Region-of-Interest," ISSCC Image Sensors, IEEE International Solid-State Circuits Conference, 2007, Session 28.2, p. 502-504. http://www.ece.umn.edu/groups/iml/publications/2007/ISSCC_Jchoi.pdf.

Ko et al., "A hemispherical electronic eye camera based on compressible silicon optoelectronics," Nature, Aug. 2008, vol. 454, p. 748-753.

Caliper Life Sciences, Living Image Software User's Manual, Version 4.2, 344 pages. http://www2.udel.edu/ctcr/sites/udel.edu.ctcr/files/Living_Image_4-2_User_Guide.pdf.

Ng et al., "Flexible image sensor array with bulk heterojunction organic photodiode," Applied Physics Letters, 2008, vol. 92, p. 213303.

Yu et al., "Directed bending of a polymer film by light," Nature, Sep. 2003, vol. 425, p. 145.

* cited by examiner

IMAGE DISPLAY CONTROL METHODS AND APPARATUS, AND DISPLAY DEVICES

CROSS-REFERENCE TO RELATED APPLICATIONS

This application is a National Phase Application of International Application No. PCT/CN2015/091624, filed on Oct. 10, 2015, which claims the benefit of priority to Chinese Patent Application No. 201410645927.0, filed on Nov. 14, 2014, and entitled "Image Display Control Methods and Apparatus, and Display Devices", each of which is incorporated by reference in its entirety.

TECHNICAL FIELD

The present application relates to the field of display technologies, and in particular, to various image display control methods and apparatus, and various display devices.

BACKGROUND

Traditional display technologies are cannot meet diversified application demands for image display. To satisfy more personalized demands, improved technologies are continuously developed from the traditional display technologies.

For example, a user may desire different display definitions for different images. Therefore, multiple display modes of different resolutions may be supported by using a display of a high resolution, or two fixed display regions that are different in resolutions but stitched in a same display, or the like.

SUMMARY

Hereinafter, a brief summary about the present application is provided in order to provide a basic understanding on certain aspects of the present application. It should be understood that this summary is not an exhaustive summary about the present application. It is not intended to determine critical or important portions of the present application, nor to limit the scope of the present application. The objective thereof is only to propose certain concepts in a simplified form, thereby using the certain concepts as a prelude of the more detailed description given later.

Embodiments of the present application provide various image display control methods and apparatus, and various display devices.

In one aspect, an embodiment of the present application provides an image display control method, comprising:

acquiring target pixel density distribution information displayed by an image;

adjusting display pixel density distribution of a display according to the target pixel density distribution information; and displaying the image according to the adjusted display.

In another aspect, an embodiment of the present application further provides an image display control apparatus, comprising:

a target pixel density distribution information acquisition module, configured to acquire target pixel density distribution information displayed by an image;

a pixel density distribution adjustment module, configured to adjust display pixel density distribution of a display according to the target pixel density distribution information; and an image display module, configured to display the image according to the adjusted display.

In still another aspect, an embodiment of the present application provides a display device, comprising a display and any foregoing image display control apparatus, wherein the image display control apparatus is in a communication connection to the display.

In the technical solutions provided in the embodiments of the present application, the image display control apparatus acquires target pixel distribution information displayed by an image, adjusts display pixel density distribution of a display according to the target pixel distribution information, and displays the image according to the adjusted display, to cause that in an image display process, overall display pixels of a display can be fully used to differently present display definition of different regions in an image and better meet diversified application needs of a user.

These and other advantages of the present application will be more obvious by means of detailed description of an optional embodiment of the present application with reference to the accompanying drawings.

BRIEF DESCRIPTION OF THE DRAWINGS

The present application can be better understood by referring to the detailed description given hereinafter in combination with the accompany drawings in which identical or similar components are denoted by identical or similar reference numbers. The accompany drawings together with the detailed description below are comprised in the specification and form parts of the specification for further illustrating optional embodiments of the present application and explaining principles and advantages of the present application by way of example, wherein.

Figure 1A:
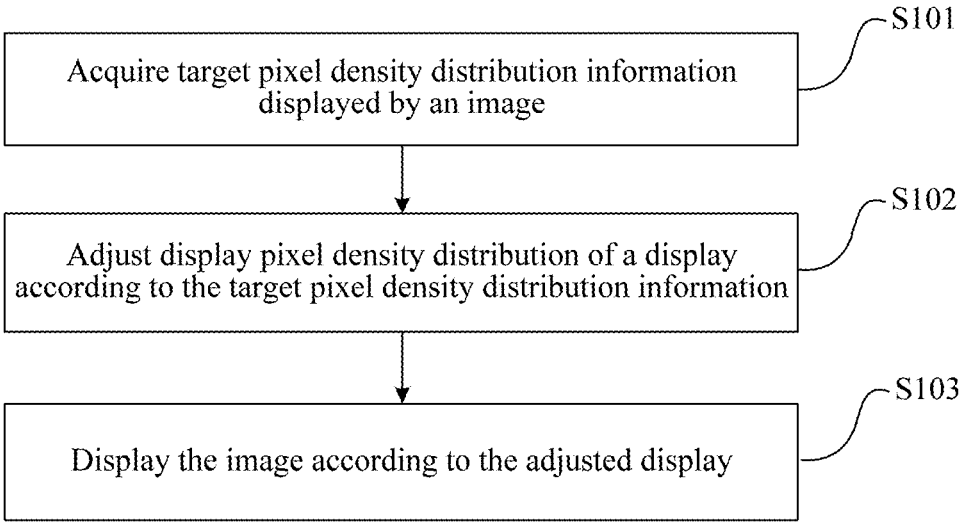
FIG. 1*a* is a flowchart of an image display control method, according to an embodiment of the present application.

Those skilled in the art should understand that elements in the drawings are only shown for the purpose of simplicity and clarity, and are not necessarily drawn to scales. For example, sizes of certain elements in the drawings may be enlarged relative to other elements so that it is helpful to improve the understanding on the embodiments of the present application.

DETAILED DESCRIPTION

Hereinafter, an exemplary embodiment of the present application will be described in combination with the drawings. For the purpose of clarity and simplicity, not all the features of the actual embodiment are described in the specification. However, it should be appreciated that it has to make a lot of decisions specific to the embodiments during a process for developing any such actual embodiments in order to achieve specific targets of developers, for example, complying with those restrictive conditions related to systems and operations, and these restrictive conditions may vary with different embodiments. Further, it should also be appreciated that although developing work may be very complex and time-consuming, such developing work is merely a routine task for those skilled in the art who benefit from the present disclosure.

Herein, to prevent unnecessary details from obscuring the present application, only the device structures and/or processing steps closely related to the scheme according to the present application are shown in the drawings, and illustrations and descriptions having little to do with the present application and of components and processing known to those skilled in the art are omitted.

The following further describes specific implementation manners of the present application in detail with reference to the accompanying drawings (the same marks in several accompanying drawings represent the same elements) and embodiments. The following embodiments are used to describe the present application, but not intended to limit the scope of the present application.

Those skilled in the art may understand that terms such as "the first" and "the second" in the present application are used only to differentiate different steps, devices, modules, or the like, do not represent any specific technical meaning, and do not represent a necessary logic order therebetween.

An inventor of the present application finds in a process of putting the embodiments of the present application into practice that when a display performs image display, display pixel density distribution of the display is generally fixed. Based on that a display with a fixed display pixel density performs image display, a display capacity of the display has certain limitations in meeting diversified application needs of a user. In a certain scenario, regions in a certain frame image generally have different meanings and/or importance to a user, that is, the user has different levels of interests in different regions in a display image. For example, in a character image display scenario, a user is more interested in a human face in an image than a scenery in the image; and for example, in a parking area surveillance video display scenario, a user is more interested in a region such as a license plate, a face of a driver in a video image than a roadside scenery in the video image; and the like. If an image display quality of a region of interest (ROI) needs to be improved, a display of a high resolution may be used to improve overall definition of the display image. However, if the display of a high resolution is used to display the image, power consumption is large. Further, if a user has different requirements on display definition of different regions in an image, for example, the user may merely pay attention to definition of a part (such as a human face, a license plate number, and another ROI) of the image, but have a low requirement on another part (such as a background and a road) in the image, and if the display of a high resolution is used to display the image, actual usage of display pixels may be low and power consumption may be high.

Therefore, an embodiment of the present application provides an image display control method, which can fully use overall pixels of a display to differently present display definition of different regions in an image, thereby better meeting diversified application needs of a user. The following describes the technical solution with reference to the accompanying drawings.

FIG. 1*a* is a flowchart of an image display control method according to an embodiment of the present application. The image display control method according to this embodiment of the present application may be executed by a certain image display control apparatus, wherein the image display control apparatus may perform image display control by executing the image display control method in, but not limited to, an application process involving display presentation, video playback, and the like. A device expression form of the image display control apparatus is not limited, for example, the image display control apparatus may be an independent component, wherein the component is in coordinate communication with a display device comprising a display, or the image display control apparatus may be used as a certain functional module to be integrated in a display device comprising a display, wherein the display device may comprise, but is not limited to, a television, a computer, a camera, a mobile phone, a video recorder, or the like.

Specifically, as shown in FIG. 1*a*, the image display control method according to this embodiment of the present application comprises:

S101. Acquire target pixel density distribution information displayed by an image.

The target pixel density distribution information displayed by the image is generally used to represent a related expectation of a user or a device for display definition of different regions in the image. For example, for a region with a high display definition expectation in the display image, it is expected that a high display pixel density is used to perform display, and displayed target pixel density corresponding to the region is high, so as to improve definition displayed by the image in the region. However, requirements on definition displayed by the image of another region in the image can be appropriately lowered, and for an image in the another region, a low display pixel density can be used to perform image display, causing differences in displayed target pixel densities corresponding to different regions in the image.

S102. Adjust display pixel density distribution of a display according to the target pixel density distribution information.

The display according to this embodiment of the present application is a display with an adjustable pixel density, and the display may comprise, but is not limited to, a flexible display, wherein the flexible display comprises at least a flexible substrate and multiple display pixels formed on the flexible substrate, and the flexible substrate can make changes such as expansion and bending to adjust the display pixel density distribution of the flexible display when meeting a certain condition. The display pixel may comprise, but is not limited to, at least one light-emitting unit; the light-emitting unit may comprise, but is not limited to, a light emitting diode (LED) light-emitting unit and an organic light emitting diode (OLED) light-emitting unit; an emitted color of the light-emitting unit may be determined according to actual needs, and may comprise, but is not limited to, one or more light-emitting subunits, wherein the light-emitting subunit may comprise an LED light-emitting subunit and an OLED light-emitting subunit; and the multiple light-emitting subunits may comprise, but are not limited to, the LED light-emitting subunit and the OLED light-emitting subunit of different colors such as red (R), green (G), blue (B), and the like.

In combination of a property that the display pixel density distribution of the display is adjustable, this embodiment of the present application adjusts the display pixel density distribution of the display according to the target pixel density distribution information, to cause that pixel density distribution of the adjusted display is corresponding to the target pixel density distribution information, or to cause that the pixel density distribution of the adjusted display is as close to the target pixel density distribution information as possible.

S103. Display the image according to the adjusted display.

The technical solution provided in this embodiment of the present application can fully use overall pixels of the display to differently present display definition of different regions of the image. Specifically, because the display pixel density distribution of the display has been adjusted according to the target pixel density distribution information displayed by the image, in the image displayed according to the adjusted display, definition of the different regions of the actually displayed image presents different distribution corresponding to the target pixel density distribution information. The solution fully uses overall display pixels of the display, which is equivalent to performing corresponding adjustment on existing display pixel density distribution of the display according to the target pixel density distribution information to achieve an effect of displaying the image by giving the different regions different display pixel densities, causing differences between definition of the different regions of the actually displayed image, thereby meeting a need of user for differently displaying image parts. The technical solutions provided in this embodiment of the present application save the power consumption, improve actual usage of the display pixels of the display, and cost low power consumption compared with the technical solution of using a display of a high resolution to implement similar display effects on the image parts; and improve flexibility of implementation manners, may flexibly adjust the display pixel density distribution of the display according to actual needs, and better meet diversified application needs of a user compared with the solution of integrating two display regions of different resolution in one display. After the display pixel densities of the display are adjusted by using the technical solutions provided in this embodiment of the present application, the display pixel densities of the display are inhomogeneously distributed. In this regard, flexible display control technologies may be determined according to actual needs, and image display control is performed according to the adjusted display, so as to improve user experience. This embodiment of the present application does not limit specific display control technologies of displaying the image according to the adjusted display.

In an optional implementation manner, a display control method of displaying the image according to the adjusted display may comprise: performing sampling processing on the image according to actual location information of a display pixel in the adjusted display; and controlling the adjusted display to display the image after the sampling processing. The solution may determine, according to actual needs, whether it is needed to perform sampling adaptation processing on an original image to be displayed according to an actual spatial location of an adjusted display pixel. If it is needed, the sampling processing may be performed on the image according to the actual location information of the display pixel in the adjusted display, achieving, based on that there are differences between the display definition of the different regions in the image, a display effect that display proportions such as sizes and shapes of the different regions in the image actually displayed by the adjusted display match display proportions such as sizes and shapes of corresponding regions in the original image, and better meeting the diversified application needs of the user.

In another optional implementation manner, a display control method of displaying the image according to the adjusted display may comprise: adjusting driver information of the image according to actual location information of a display pixel in the adjusted display; and controlling, according to the adjusted driver information, the adjusted display to display the image. The solution may perform drive adaptation processing on a scanning drive manner of the display according to the actual spatial location of the adjusted display pixel, achieving, based on that there are differences between the display definition of the different regions in the image, a display effect that display proportions of the different regions in the image actually displayed by the adjusted display match display proportions of corresponding regions in the original image, and better meeting the diversified application needs of the user.

Further, description is made by giving examples with reference to FIG. 2*a* to FIG. 2*d*. This part is merely exemplary description, and should not be understood as a limitation to essence of the technical solutions of the present application.

Figure 2A:
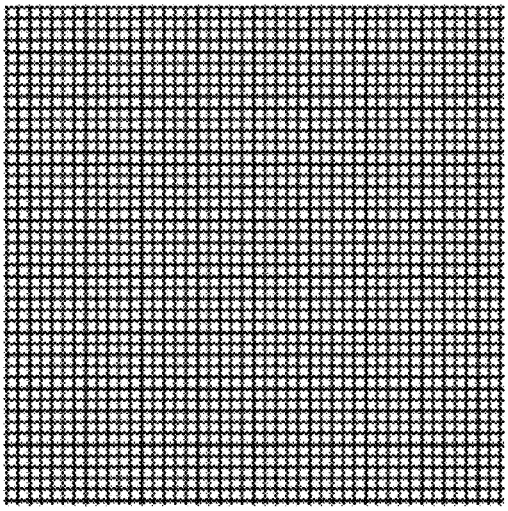
FIG. 2*a* is an optional example of display pixel density distribution of a display before adjustment, according to an embodiment of the present application.
Figure 2B:
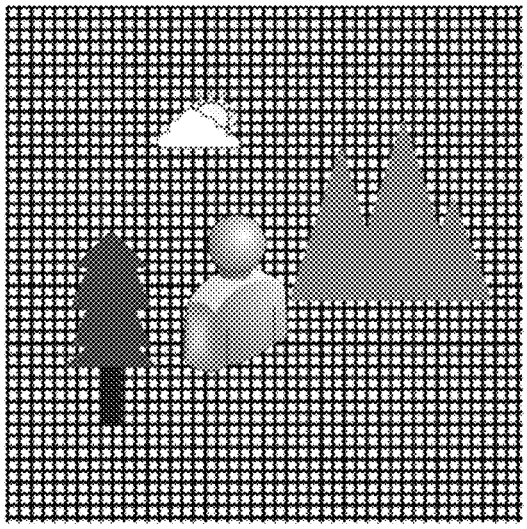
FIG. 2*b* is an optional example of a display effect of an image displayed according to a display before adjustment, according to an embodiment of the present application.

For the display pixel density distribution of the display before adjustment, as shown in FIG. 2*a*, the display pixel densities are homogeneous. The image is displayed according to the display before the adjustment, wherein display pixel densities of different regions (the different regions such as a person, a tree, and a sun in the figure) in the image displayed by using the display are same. Therefore, definition of the different regions of the actually displayed image is same, as shown in FIG. 2*b*.

Figure 2C:
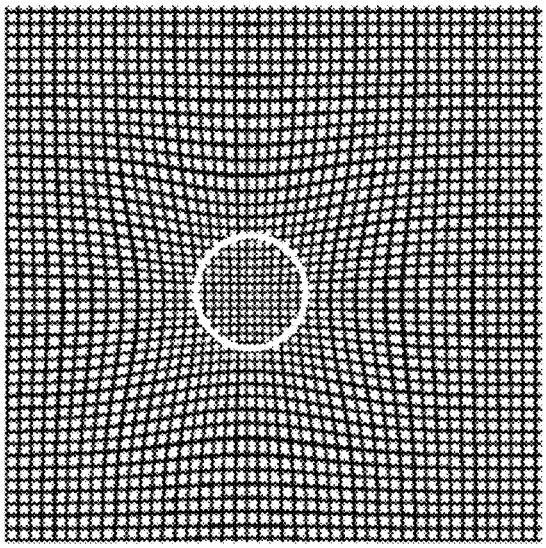
FIG. 2*c* is an optional example of display pixel density distribution of a display after adjustment, according to an embodiment of the present application.
Figure 2D:
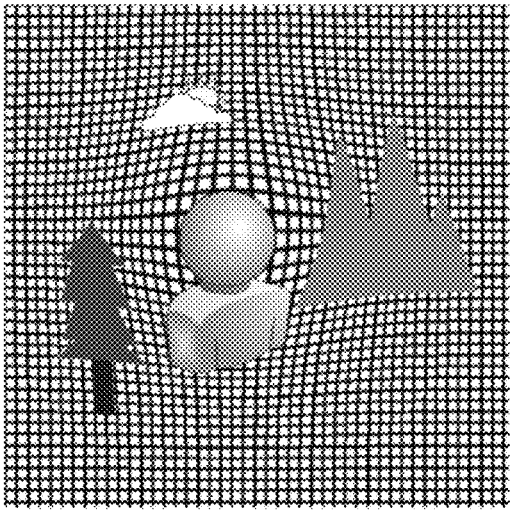
FIG. 2*d* is an optional example of a display effect of an image displayed according to a display after adjustment, according to an embodiment of the present application.

After the display pixel density distribution of the display is adjusted according to the target pixel density distribution information, the display pixel densities of the display present inhomogeneous distribution. As shown in FIG. 2*c*, a display pixel density of a local region (such as a center region) is high, and a display pixel density of another region (such as a marginal region) is low. The image is displayed according to the adjusted display, wherein there may be differences between the display pixel densities of the different regions (the different regions such as a person, a tree, and a sun in the figure) in the image displayed by using the display. Therefore, there may also correspondingly be differences between the definitions of the different regions of the actually displayed image. In a certain scenario, if an impact that may be caused to the display effect by another display control factor such as the driver information is not taken into consideration, the image displayed by the adjusted display may make local deformation. For example, it is assumed that the driver information of the image is driven according to index information of display pixels of the display, wherein the index information is generally used for representing numbers of the display pixels of the display in a display pixel array, for example, a certain display pixel is a display pixel in N row and M column, and the index information of the display pixels is unchanged before and after the display pixel densities are adjusted. If the index information of the image is unchanged, driving is still performed according to the index information of the display pixels of the display. Time intervals of two neighboring display pixels of the display are driven to be unchanged, and when the adjusted display is driven according to the driver information to display the image, an image region (such as a human body part in FIG. 2*d*) displayed in a region of a high display pixel density is deformed, for example, being enlarged, so as to achieve a clearer display effect. If it is in a certain case of an actual application, for example, this deformation effect is expected to be achieved actually, or a user does not mind the deformation effect, the display effect may not be adjusted. In order to achieve a display effect the same display proportion as but different definition from the different regions of the original image, optionally, the sampling processing may be first performed on the image according to the actual location information of the display pixel in the adjusted display, and pixel distribution of the image after the sampling processing is corresponding to the actual location information of the display pixel in the adjusted display.

Figure 2E:
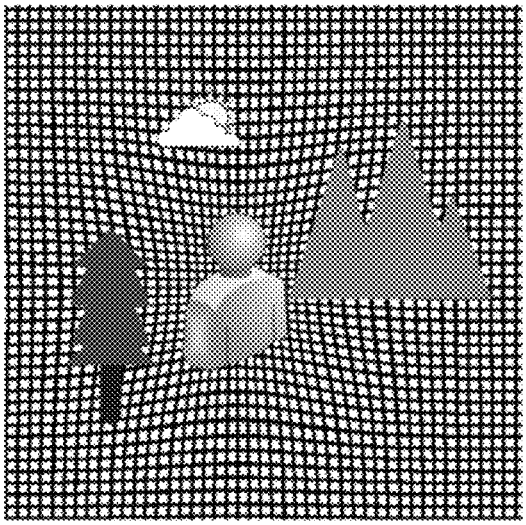
FIG. 2*e* is an optional example of an improved display effect of an image displayed by a display after adjustment, according to an embodiment of the present application.

In this way, even if the driver information of the image information is unchanged, adjustment may also be implemented on the display proportions of the different regions of the actually displayed image by adjusting an image to be displayed. For the display effect after the adjustment shown in FIG. 2*e*, there are differences (for example, in the figure, a display pixel density of a human body display part displayed by using the adjusted display is high, and definition of a displayed human body image is high, or the like) between display definition of the different regions of the image, and the display proportions such as sizes and shapes of different parts in the image match the display proportions such as sizes and shapes of the corresponding regions in the original image shown in FIG. 2*a*. Or, the driver information of the image may also be adjusted according to the actual location information of the display pixel in the adjusted display. For example, the driver information of the image is adjusted to be driven according to the actual location information of the display pixel. In this solution, even if the sampling processing is not performed on the image, an effect similar to adjusting the display proportions of the different regions of the actually displayed image may also be achieved by adjusting the driver information used for controlling the image display.

In another optional implementation manner, image display control may also be performed by combining multiple display control methods such as performing the sampling adaptation processing on the image and performing adaptation adjustment on the driver information of the image, so as to achieve a preferred image display effect and improve user experience, which is not described herein again.

In the technical solutions provided in this embodiment of the present application, a manner of acquiring the target pixel density distribution information is not limited. In an optional implementation manner, a first region of the image may be acquired; the target pixel density distribution information may be determined according to the first region; in the target pixel density distribution information, a displayed target pixel density corresponding to the first region is different from a displayed target pixel density corresponding to a second region; and the second region comprises at least a partial region in the image except the first region.

The first region may comprise the at least the partial region, whose definition needs to be adjusted, in the image. It would be well if description is made by using that image definition displayed by a display in a case in which display pixels are homogeneously distributed is contrast display definition. For example, the first region comprises at least a partial region, whose display definition needs to be enhanced compared with the contrast display definition, in the image. In this case, in the target pixel density distribution information, the displayed target pixel density corresponding to the first region is greater than the displayed target pixel density corresponding to the second region. After the display pixel densities of the display are adjusted according to the target pixel density distribution information, referring to FIG. 4*c*, if a region in a white circle in the figure represents an actually displayed pixel density corresponding to the first region, and a region in a black circle represents an actually displayed pixel density corresponding to the second region, the actually displayed pixel density corresponding to the first region represented by the region in the white circle is greater than the actually displayed pixel density corresponding to the second region represented by the region in the black circle, and actually display definition of the first region is greater than actually display definition of the second region. For example again, the first region comprises at least a partial region, whose display definition needs to be weakened compared with the contrast display definition, in the image. In this case, in the target pixel density distribution information, the displayed target pixel density corresponding to the first region is less than the displayed target pixel density corresponding to the second region. After the display pixel densities of the display are adjusted according to the target pixel density distribution information, referring to FIG. 4*c*, if a region in a black circle in the figure represents an actually displayed pixel density corresponding to the first region, and a region in a white circle represents an actually displayed pixel density corresponding to the second region, the actually displayed pixel density corresponding to the first region represented by the region in the black circle is greater than the actually displayed pixel density corresponding to the second region represented by the region in the white circle, and actually display definition of the first region is greater than actually display definition of the second region. The implementation manners in the foregoing solutions are very flexible, which can better meet diversified application needs of a user.

A manner of acquiring the first region of the image may be determined according to actual needs and is very flexible.

In an optional implementation manner, the first region of the image may be determined according to ROI information, that is: acquiring the information of the ROI; and determining the first region of the image according to the information of the ROI. The ROI may comprise, but is not limited to one or more of the following regions: at least one region (that is, a user selection region of the image) selected by a user in the image, at least one region (that is, a user gaze region of the image) gazed at by the user in the image, and an ROI obtained by automatically detecting, by the image display control apparatus, the image.

Figure 3A:
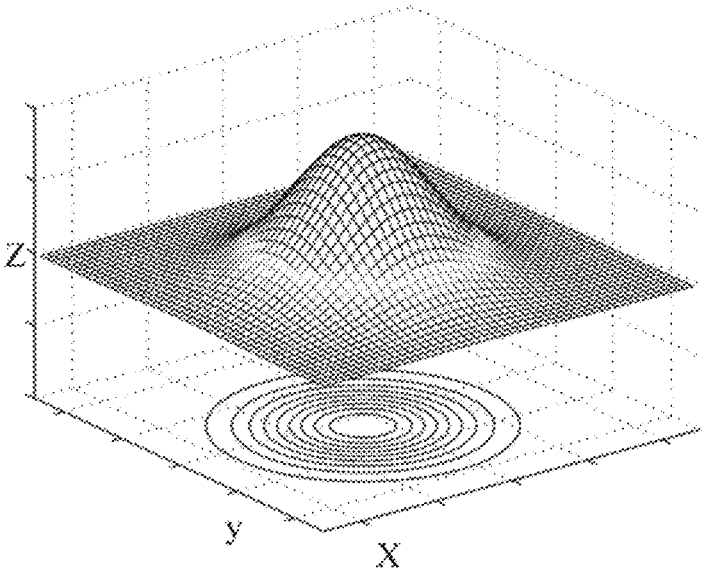
FIG. 3*a* is an optional example of interest information of an image, according to an embodiment of the present application.
Figure 3B:
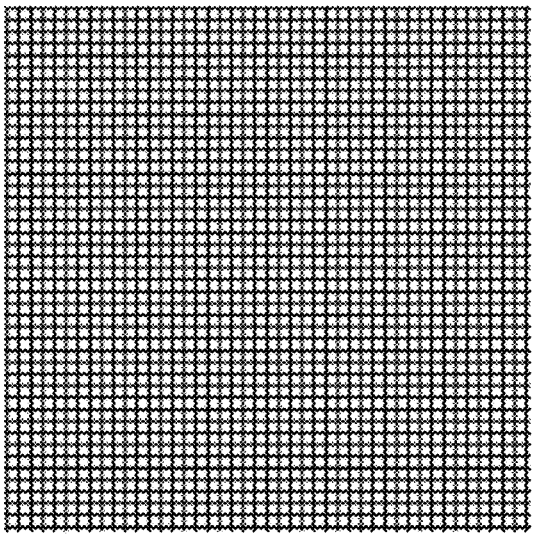
FIG. 3*b* is an optional example of display pixel density distribution of a display before adjustment corresponding to an embodiment in FIG. 3*a;*
Figure 3C:
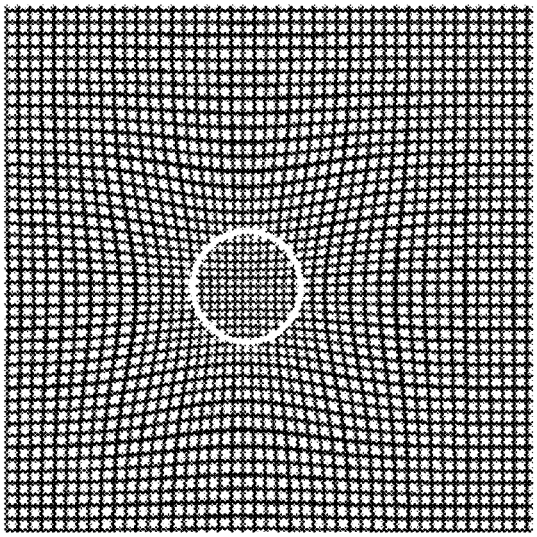
FIG. 3*c* is an optional example of display pixel density distribution of a display after adjustment corresponding to an embodiment in FIG. 3*a;*

For example, interest information of the image is as shown in FIG. 3*a*, wherein an X-axis and a Y-axis represent spatial distribution of different regions of a certain two-dimensional image; a Z-axis represents levels of interests in the different regions of the image. A higher value for Z represents a higher level of interest in corresponding regions of the image, and vice versa. In an actual application, an image region whose a level of interest exceeds a set threshold may be determined as the first region. The target pixel density distribution information is determined according to the first region, wherein in the target pixel density distribution information, the displayed target pixel density corresponding to the first region is greater than the displayed target pixel density corresponding to another region. Therefore, after the display pixel density of the display is adjusted according to the target pixel density distribution information, the display pixel density distribution of the display presents inhomogeneous distribution the same as or similar to the target pixel density distribution information. For display pixel density distribution contrast of the display before and after adjustment, referring to FIG. 3*b* and FIG. 3*c*, it can be seen that an actually displayed pixel density (such as an displayed pixel density in a region in a white circle in FIG. 3*c*) corresponding to the first region whose level of interest is high is greater than an actually displayed pixel density corresponding to the another region.

Figure 4A:
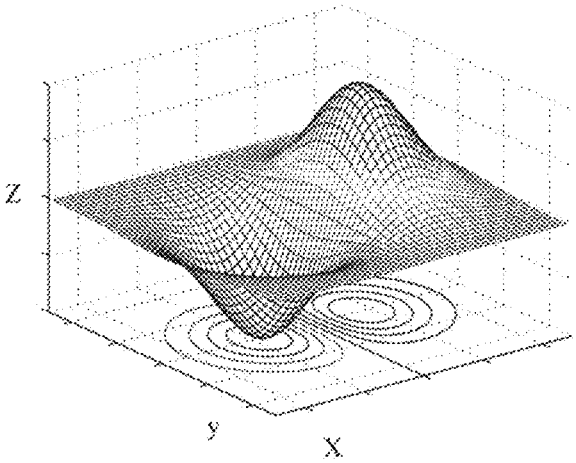
FIG. 4*a* is another optional example of interest information of an image, according to an embodiment of the present application.
Figure 4B:
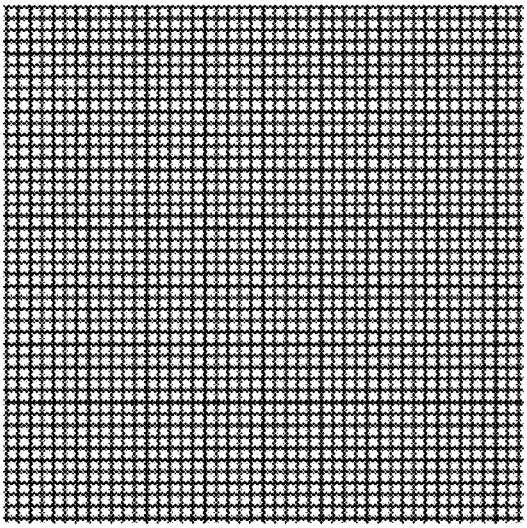
FIG. 4*b* is an optional example of display pixel density distribution of a display before adjustment corresponding to an embodiment in FIG. 4*a;*
Figure 4C:
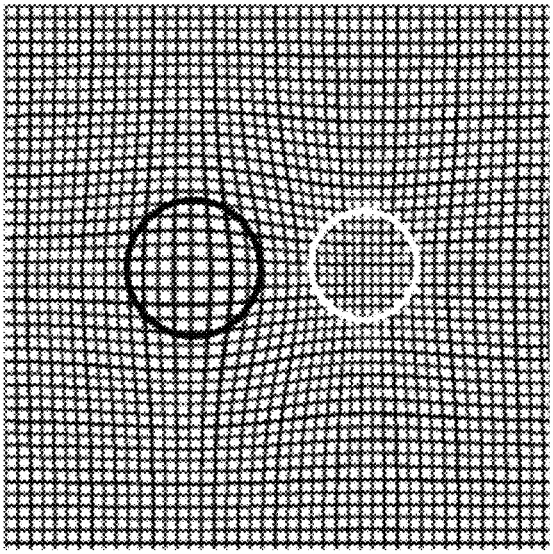
FIG. 4*c* is an optional example of display pixel density distribution of a display after adjustment corresponding to an embodiment in FIG. 4*a;*

For example again, interest information of the image is as shown in FIG. 4*a*, wherein an X-axis and a Y-axis represent spatial distribution of different regions of a certain two-dimensional image; a Z-axis represents levels of interests in the different regions of the image. A higher value for Z represents a higher level of interest in corresponding regions of the image, and vice versa. In an actual application, an image region whose a level of interest exceeds a first set threshold may be determined as the first region, and an image region whose a level of interest is lower than a second set threshold may be determined as the second region. The target pixel density distribution information is determined according to the first region and the second region, wherein in the target pixel density distribution information, the displayed target pixel density corresponding to the first region is greater than the displayed target pixel density corresponding to the second region. Therefore, after the display pixel density of the display is adjusted according to the target pixel density distribution information, the display pixel density distribution of the display presents inhomogeneous distribution the same as or similar to the target pixel density distribution information. For display pixel density distribution contrast of the display before and after adjustment, referring to FIG. 4*b* and FIG. 4*c*, it can be seen that an actually displayed pixel density (such as an displayed pixel density in a region in a white circle in FIG. 4*c*) corresponding to the first region whose level of interest is high is greater than an actually displayed pixel density corresponding to the second region (such as an displayed pixel density in a region in a black circle in FIG. 4*c*).

The solution determines the first region of the image according to the ROI. The determined first region may be a region corresponding to the ROI, or the determined first region may be a region corresponding to a non-ROI, in the image, to cause that determination of the first region fits actual user needs more, which can better meet diversified application needs of a user.

In another optional implementation manner, the first region of the image may be determined according to a result of an image analysis, that is: performing the image analysis on the image; and determining the first region of the image according to a result of the image analysis. For example, human face identification is performed on an image to be displayed, and a human face region is determined as the first region of the image according to an identification result. For example again, moving object identification is performed on an image to be displayed, and a region corresponding to the moving object is determined as the first region of the image according to an identification result. The solution may determine the first region according to the image analysis result of the image to be displayed, to cause that the determination of the first region is more intelligent, and efficiency and universality of the determination of the first region are improved.

Further, the first region may comprise one or more first subregions. The first subregion comprises at least a partial region, whose display definition needs to be enhanced compared with the contrast display definition, in the image. In a case in which the first region comprises the multiple first subregions, distribution of the multiple first subregions in the image may be continuous, for example, boundaries of the multiple first subregions are jointed; or the distribution of the multiple first subregions in the image may be discrete, for example, the boundaries of the multiple first subregions are disjointed with each other, or a boundary of at least one first subregion of the multiple first subregions is disjointed with a boundary of another first subregion, wherein display definition of the first subregion may be enhanced or weakened compared with the contrast display definition, which is not limited in this embodiment of the present application. The solution improves flexibility of the determination of the first region in which the image display definition needs to be adjusted, in the image, which can better meet diversified application needs of a user.

Moreover, in the case in which the first region comprises the multiple first subregions, displayed target pixel densities corresponding to the first subregions may be determined according to actual needs.

In an optional implementation manner, all the displayed target pixel densities respectively corresponding to the different first subregions in the target pixel density distribution information are the same. For example, the first region comprises the multiple first subregions (such as multiple human faces) in discrete distribution in a certain image to be displayed (such as a video surveillance image comprising multiple persons), and target pixel densities corresponding to the first subregions are the same. The solution may perform adjustment of the same degree on display definition of the multiple first subregions in the image (for example, displayed target pixel densities corresponding to the human faces are all enhanced or weakened to a same target pixel density), to cause the display definition of the first subregions to be the same or as close as possible.

In another optional implementation manner, in the target pixel density distribution information, a displayed target pixel density corresponding to the at least one of the first subregions is different from a displayed target pixel density corresponding to any other first subregion. For example, the first region comprises three first subregions A, B, and C in continuous distribution in a certain image to be displayed, and displayed target pixel densities corresponding to the first subregions A, B, and C are respectively A', B', and C', and the target pixel densities A', B', and C' increase progressively. The solution may perform adjustment of different degrees on display definition of the multiple first subregions in the image (such as gradually clear adjustment, gradually fuzzy adjustment, partially clear and partially fuzzy adjustment), to cause that the display definition of the first subregions presents a certain degree of differentiation.

In this embodiment of the present application, after the target pixel density distribution information of the image to be displayed is acquired, the pixel density distribution of the display may be adjusted according to the target pixel density distribution information. A manner of adjusting the pixel density distribution of the display may be selected according to actual needs, which is not limited in this embodiment of the present application. In an optional implementation manner, deformation control information of a controllable deformation material part may be determined according to the target pixel density distribution information; and the controllable deformation material part may be controlled, according to the deformation control information, to make deformation, so as to correspondingly adjust the display pixel density distribution of the display by means of the deformation of the controllable deformation material part. The solution is simple and easy to be implemented by adjusting the pixel distribution of the display by means of controlling the deformation of the controllable deformation material part.

Figure 1B:
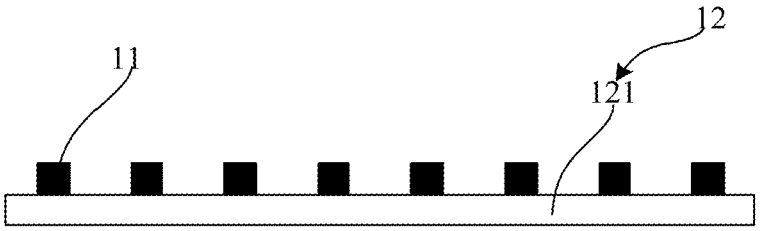
FIG. 1*b* is a schematic structural diagram of a first display with an adjustable pixel density, according to an embodiment of the present application.

FIG. 1*b* is a schematic structural diagram of a display with an adjustable pixel density according to an embodiment of the present application. As shown in FIG. 1*b*, the display with an adjustable pixel density according to this embodiment of the present application comprises: multiple display pixels 11 and a controllable deformation material part 12, wherein the display performs image display by using the display pixel 11; the multiple display pixels 11 are in array distribution; the controllable deformation material part 12 is separately connected to the multiple display pixels 11; and the controllable deformation material part 12 may make deformation under an external field and correspondingly adjust density distribution of the multiple display pixels 11 by means of the deformation of the controllable deformation material part 12. The controllable deformation material part may be made to make deformation by changing a certain external functional factor (such as the external field) acting thereupon, and when the external field acting thereupon is revoked or changed, the deformation of the controllable deformation material part may restore. The display pixel may comprise, but is not limited to, at least one light-emitting unit; the light-emitting unit may comprise, but is not limited to, an LED light-emitting unit and an OLED light-emitting unit; an emitted color of the light-emitting unit may be determined according to actual needs, and may comprise, but is not limited to, one or more light-emitting subunits, wherein the light-emitting subunit may comprise an LED light-emitting subunit and an OLED light-emitting subunit; and the multiple light-emitting subunits may comprise, but are not limited to, the LED light-emitting subunit and the OLED light-emitting subunit of different colors such as red (R), green (G), blue (B), and the like.

In the multiple display pixels in the array distribution comprised in the display according to this embodiment of the present application, the display pixels may be tightly connected to the controllable deformation material part by using a manner such as, but not limited to, bonding. In this way, when the controllable deformation material part make the deformation, spacings between the display pixels may be correspondingly adjusted, thereby changing pixel distribution of the display pixels, so as to achieve an effect of giving, according to actual needs, different regions of the display different display pixel density distribution.

In a process of actually using the technical solution provided in this embodiment of the present application, the external field in inhomogeneous distribution may be acted upon different regions of the controllable deformation material part, to cause that the different partial regions of the controllable deformation material part make deformation of different degrees, thereby adjusting overall density distribution of the display pixels. Optionally, the external field may be acted upon a region in which the controllable deformation material part is not overlapped with the multiple display pixels. In this way, a region in which the controllable deformation material part is overlapped with the display pixels may be made not to make deformation, and the density distribution of the display pixels is changed by means of deformation of another part of the controllable deformation material part. The solution is beneficial to avoiding damages caused by the deformation of the controllable deformation material part to the display pixels.

Further, the controllable deformation material part may be prepared by selecting, according to needs, at least one proper controllable deformation material, so that the controllable deformation material part has a property of being deformable and being deformable and restorable. Optionally, the controllable deformation material part is prepared from at least one or more of the following controllable deformation materials: a piezoelectric material, an electroactive polymer (EAP), a photo-induced deformation material, and a magnetostrictive material.

The piezoelectric material may make mechanical deformation under an electric field. A controllable deformation material part prepared from the piezoelectric material is called a piezoelectric material part below. By using this physical property of the piezoelectric material, this embodiment of the present application may determine, according to but not limited to the target pixel density distribution information, needed electric field control information used for making the piezoelectric material part make corresponding mechanical deformation; control, according to the electric field control information, the electric field acted upon the piezoelectric material part, to cause that the piezoelectric material part makes the corresponding mechanical deformation; and correspondingly adjust the pixel density distribution of the display by means of the mechanical deformation of the piezoelectric material part, thereby achieving an objective of adjusting the display pixel density distribution of the display according to the target pixel density distribution information. The piezoelectric material may comprise, but is not limited to, at least one of the following materials: a piezoelectric ceramic and a piezoelectric crystal. The solution can fully use the physical property of the piezoelectric material to adjust the pixel density distribution of the display.

The EAPs are a category of polymer materials that can change shapes or sizes thereof under the electric field. A controllable deformation material part prepared from the EAP is called an EAP part below. By using this physical property of the EAP, this embodiment of the present application may determine, according to but not limited to the target pixel density distribution information, needed electric field control information used for making the EAP part make corresponding deformation; control, according to the electric field control information, the electric field acted upon the EAP part, to cause that the EAP part makes the corresponding deformation; and correspondingly adjust the pixel density distribution of the display by means of the deformation of the EAP part, thereby achieving an objective of adjusting the display pixel density distribution of the display according to the target pixel density distribution information. The EAP may comprise, but is not limited to, at least one of the following EAPs: an electronic EAP and an ionic EAP; the electronic EAP comprises at least one of the following EAPs: a ferroelectric polymer (such as polyvinylidene fluoride), an electrostrictive graft elastomer, and a liquid crystal elastomer; and the ionic EAP comprises at least one of the following EAPs: an electrorheological fluid, an ionic polymer-metal composite, or the like. The solution can fully use the physical property of the EAP to adjust the pixel density distribution of the display.

The photo-induced deformation materials are a category of high polymer materials that can change shapes or sizes thereof under a light field. A controllable deformation material part prepared from the photo-induced deformation material is called a photo-induced deformation material part below. By using this physical property of the photo-induced deformation material, this embodiment of the present application may determine, according to but not limited to the target pixel density distribution information, needed light field control information used for making the photo-induced deformation material part make corresponding deformation; control, according to the light field control information, the light field acted upon the photo-induced deformation material part, to cause that the photo-induced deformation material part makes the corresponding deformation; and correspondingly adjust the pixel density distribution of the display by means of the deformation of the photo-induced deformation material part, thereby achieving an objective of adjusting the display pixel density distribution of the display according to the target pixel density distribution information. The photo-induced deformation material may comprise, but is not limited to, at least one of the following materials: a photostrictive ferroelectric ceramic and a photo-induced deformation polymer; the photostrictive ferroelectric ceramic comprises, but is not limited to, a PLZT ceramic; and the photo-induced deformation polymer comprises, but is not limited to, a photo-induced deformation liquid crystal elastomer. The solution can fully use the physical property of the photo-induced deformation material to adjust the pixel density distribution of the display.

The magnetostrictive materials are a category of magnetic materials that can change magnetized states thereof under a magnetic field and further change sizes thereof. A controllable deformation material part prepared from the magnetostrictive material is called a magnetostrictive material part below. By using this physical property of the magnetostrictive material, this embodiment of the present application may determine, according to but not limited to the target pixel density distribution information, needed magnetic field control information used for making the magnetostrictive material part make corresponding deformation; control, according to the magnetic field control information, the magnetic field acted upon the magnetostrictive material part, to cause that the magnetostrictive material part makes the corresponding deformation; and correspondingly adjust the pixel density distribution of the display by means of the deformation of the magnetostrictive material part, thereby achieving an objective of adjusting the display pixel density distribution of the display according to the target pixel density distribution information. The magnetostrictive material may comprise, but is not limited to, a rare-earth giant magnetostrictive material such as an alloy $Tbo_{0.3}Dy_{0.7}Fe_{1.95}$ material with a compound $(Tb,Dy)Fe_2$ matrix. The solution can fully use the physical property of the magnetostrictive material to adjust the pixel density distribution of the display.

In the technical solution provided in this embodiment of the present application, specific structures and connection manners of the display pixels and the controllable deformation material part may be determined according to actual needs, and actual manners are very flexible.

In an optional implementation manner, as shown in FIG. 1*b*, the controllable deformation material part 12 comprises: a controllable deformation material layer 121. The multiple display pixels 11 are in the array distribution and are connected to one surface of the controllable deformation material layer 121. Optionally, the multiple display pixels may be selected according to actual technique conditions to be directly formed on the controllable deformation material layer 121, or the multiple display pixels and the controllable deformation material layer 121 may be respectively prepared, and both sides can be tightly connected to each other in a manner such as, but not limited to, bonding. The solution is of a simple structure and is easy to be implemented.

Figure 1C:
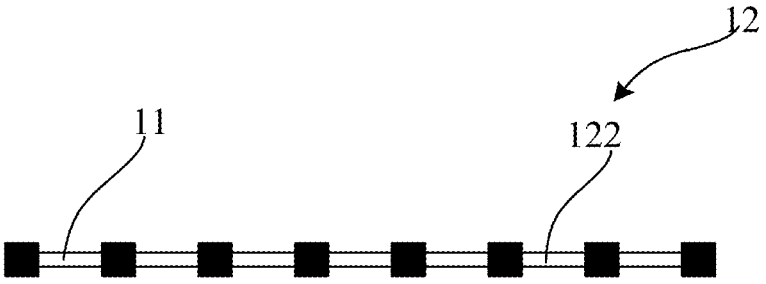
FIG. 1*c* is a schematic structural diagram of a second display with an adjustable pixel density, according to an embodiment of the present application.

In another optional implementation manner, as shown in FIG. 1*c*, the controllable deformation material part 12 comprises multiple controllable deformation material connection subparts 122. The multiple controllable deformation material connection subparts 122 are in array distribution to be correspondingly connected to the multiple display pixels 11 in the array distribution, that is, the multiple display pixels in the array distribution are integrated by means of the multiple controllable deformation material connection subparts in the array distribution. Optionally, the multiple controllable deformation material connection subparts may be formed in a spaced region of pixels of a display pixel array according to actual techniques, and the multiple controllable deformation material connection subparts can be connected to corresponding display pixels in a manner such as, but not limited to, abutting and bonding. The density distribution of the display pixels can be adjusted by controlling deformation of the multiple controllable deformation material connection subparts, which is of a simple structure and is easy to be implemented.

Figure 1D:
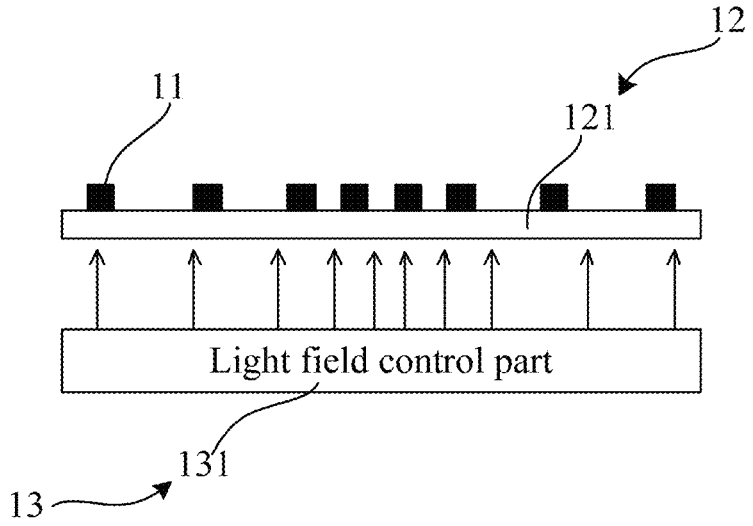
FIG. 1*d* is a schematic structural diagram of a third display with an adjustable pixel density, according to an embodiment of the present application.
Figure 1E:
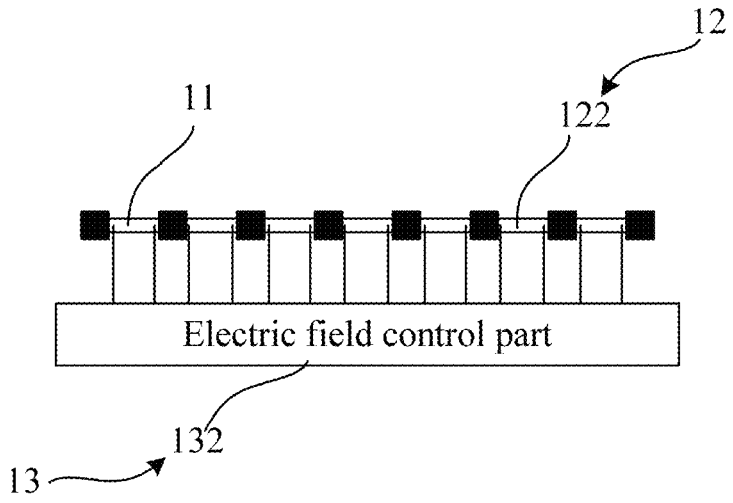
FIG. 1*e* is a schematic structural diagram of a fourth display with an adjustable pixel density, according to an embodiment of the present application.

Further, as shown in FIG. 1*d* and FIG. 1*e*, the display may further comprise: a deformation control part 13. The deformation control part 13 is used for adjusting distribution of the external field acted on the controllable deformation material part 12, so as to control the controllable deformation material part 12 to make corresponding deformation. In this way, when the controllable deformation material part 12 makes the deformation, spacing between the display pixels 11 may be correspondingly adjusted, thereby changing density distribution of the display pixels 11, so as to achieve an effect of giving, according to actual needs, different regions of the display different display pixel density distribution.

Figure 1F:
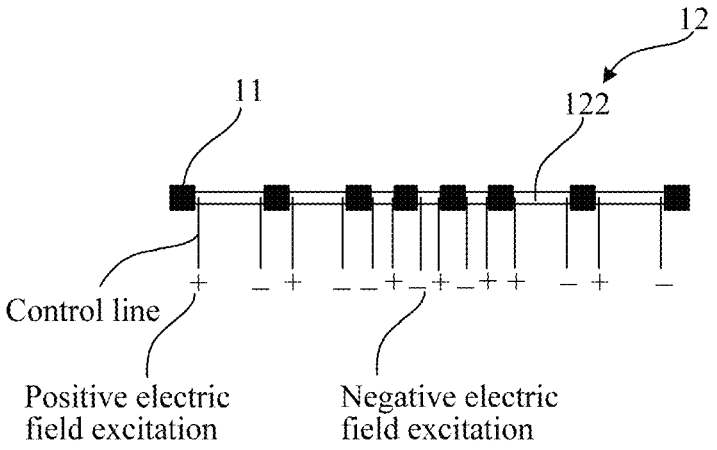
FIG. 1*f* is an example of a scenario in which a display performs pixel density adjustment in an incentive case of an inhomogeneous light field, according to an embodiment of the present application.

Optionally, as shown in FIG. 1*d*, the deformation control part may comprise a light field control part 131. The light field control part 131 is used for adjusting distribution of the external light field acted on the controllable deformation material part 12, so as to control the controllable deformation material part 12 to make corresponding deformation. In this case, the controllable deformation material part 12 may comprise at least a photo-induced deformation material part prepared from the photo-induced deformation material. For example, the photo-induced deformation material part may comprise at least a photo-induced deformation material layer prepared from the photo-induced deformation material, or the photo-induced deformation material part may comprise at least multiple photo-induced deformation material connection subparts prepared from the photo-induced deformation material. The light field control part 131 excites different regions of the controllable deformation material part 12 to make deformation of different degrees by changing the distribution of the light field acted on the controllable deformation material part (distributed light fields of different intensities acted on the controllable deformation material part 12 are represented by using arrow density in FIG. 1*d*), and correspondingly adjusts spacing between the display pixels 11 by means of the deformation of the controllable deformation material part 12, thereby changing density distribution of the display pixels 11, so as to achieve an effect of giving, according to actual needs, different regions of the display different display pixel density distribution. Optionally, as shown in FIG. 1*e*, the deformation control part may comprise an electric field control part 132. The electric field control part 132 is used for adjusting distribution of an external electric field acted on the controllable deformation material part, so as to control the controllable deformation material part to make corresponding deformation. In this case, the controllable deformation material part 12 may comprise at least a piezoelectric material part (such as a piezoelectric material layer or a piezoelectric material connection subparts) prepared from the piezoelectric material, or the controllable deformation material part 12 may comprise at least an EAP part (such as an EAP layer or an EAP connection subparts) prepared from the EAP. As shown in FIG. 1*e*, the electric field control part may be connected to the controllable deformation material part by using a control line. The electric field control part 132 excites different regions of the controllable deformation material part 12 to make deformation of different degrees by changing the distribution of the electric field acted on the controllable deformation material part. If an electric field acted on the controllable deformation material part 12 is a zero electric field, the controllable deformation material part 12 makes no deformation (it would be well to call it as zero electric field excitation); and if changes in electric field strength distribution (such as "+" positive electric field excitation and "−" negative electric field excitation shown in the figure) acted on the controllable deformation material part 12 cause that there are differences between electric field strength acted on different regions of the controllable deformation material part 12, as shown in FIG. 1*f*, in this way, the different regions of the controllable deformation material part 12 may make deformation of different degrees, and correspondingly adjust spacing between the display pixels 11 by means of the deformation of the controllable deformation material part 12, thereby changing overall pixel density distribution of the display, so as to achieve an effect of giving, according to actual needs, different regions of the display different display pixel density distribution.

In this embodiment of the present application, the controllable deformation material part may be directly and may also be indirectly connected to the deformation control part. The deformation control part may be used as a part of the display, or the deformation control part may also not be used as a part of the display. The display may also be connected to the deformation control part in manners of reserving pins and interfaces. The external field acted on the controllable deformation material part may comprise, but is not limited to an electric field, a magnetic field, a light field, and the like. Hardware and software structures used for generating the electric field, hardware and software structures used for generating the magnetic field, hardware and software structures used for generating the light field, and the like can be implemented by using the corresponding prior art according to actual needs, which is not described in this embodiment of the present application again.

Figure 1G:
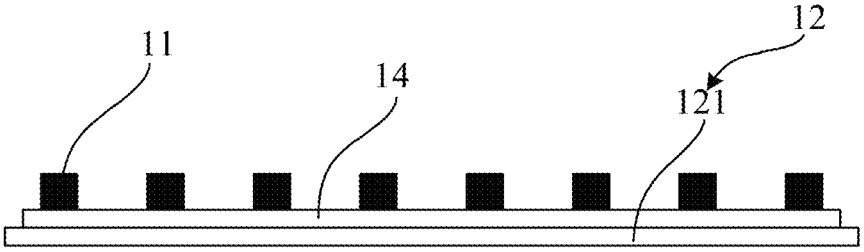
FIG. 1*g* is a schematic structural diagram of a fifth display with an adjustable pixel density, according to an embodiment of the present application.
Figure 1H:
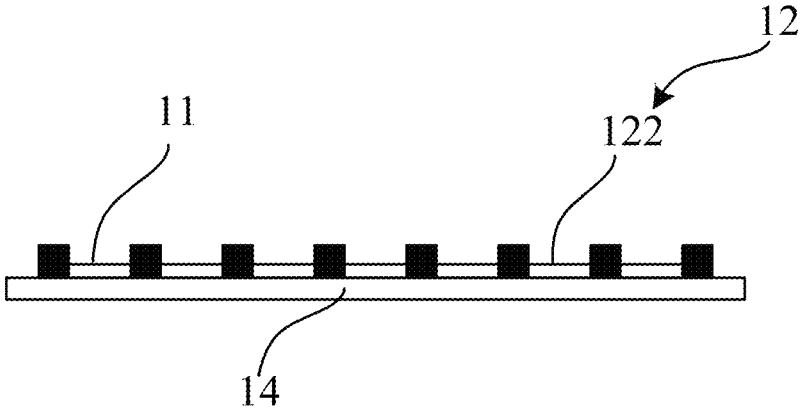
FIG. 1*h* is a schematic structural diagram of a sixth display with an adjustable pixel density according to an embodiment of the present application.

Optionally, the display may further comprise a flexible substrate, wherein the flexible substrate may comprise, but is not limited to, a flexible plastic substrate which has certain flexibility, and a shape of the flexible substrate may also be changed according to needs. The display pixels and the controllable deformation material part may be set on the same side or different sides of the flexible substrate. For example, as shown in FIG. 1*g*, the multiple display pixels 11 are connected to one surface of a flexible substrate 14, and a controllable deformation material part (such as the controllable deformation material layer 121) is connected to the other surface of the flexible substrate 14. For example again, as shown in FIG. 1*h*, the multiple display pixels 11 are connected to one surface of the flexible substrate 14, and a controllable deformation material part (such as the controllable deformation material connection subpart 122) is connected to corresponding display pixels and is located on a same surface of the flexible substrate 14 as the display pixels 11. Not only can the solution control a controllable deformation material part to make deformation by means of an external field acted on the controllable deformation material part to indirectly adjust overall pixel density distribution of a display and achieve that a pixel density of the display is adjustable, but also can flexibly change a shape of the display owing to a use of a flexible substrate, for example, bending a flat display to a certain angle to obtain a curved display, thereby meeting application needs such as diversified image display and decorations.

Figure 1I:
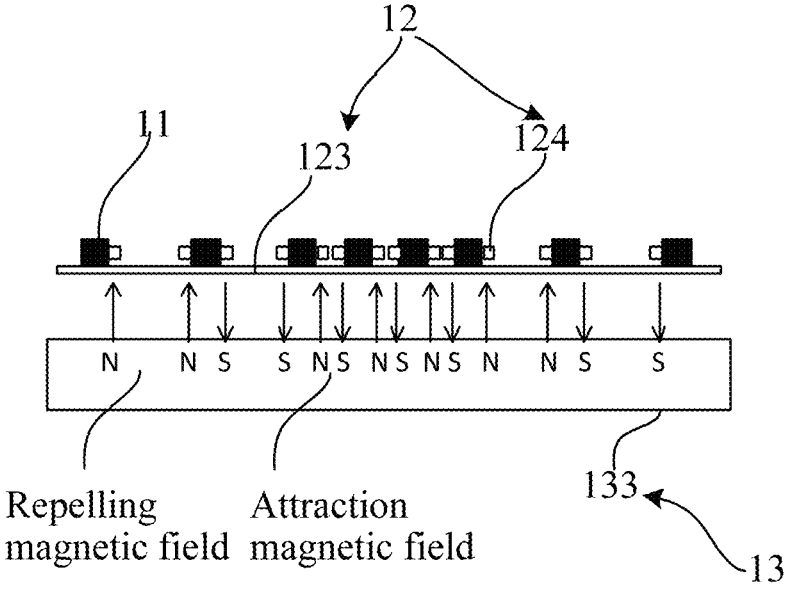
FIG. 1*i* is a schematic structural diagram of a seventh display with an adjustable pixel density, according to an embodiment of the present application.

FIG. 1*i* is a schematic structural diagram of a seventh display with an adjustable pixel density according to an embodiment of the present application. In a display shown in FIG. 1*i*, the controllable deformation material part 12 comprises: a flexible substrate 123 and multiple magnetic conductive material parts 124; multiple display pixels 11 are respectively connected to the flexible substrate 123; at least a part of the display pixels 11 is connected to the multiple magnetic conductive material parts 124; the flexible substrate 123 is made to make corresponding deformation by changing a magnetic field acted on the magnetic conductive material parts 124; and density distribution of the multiple display pixels 11 is correspondingly adjusted by means of the deformation. For example, one magnetic conductive material part 124 may be set on a side of each display pixel. Optionally, the display pixels 11 are respectively bonded to the flexible substrate 123 and the magnetic conductive material part 124. The magnetic conductive material part may comprise a magnetic pole prepared form a magnetic conductive material, wherein the magnetic conductive material may use, but is not limited to, one or more of a soft magnetic material, a silicon sheet, a permalloy, a ferrite, an amorphous soft magnetic alloy, a nanocrystalline soft magnetic alloy, and the like. Magnetic conductive performance of a magnetic conductive material part prepared by using the soft magnetic material is good, and remanence is very small after the magnetic field is revoked, which is convenient for adjustment for the next time.

Further, optionally, the deformation control part 13 according to this embodiment of the present application may further comprise: a magnetic field control part 133. The magnetic field control part 133 is used for adjusting distribution of an external magnetic field acted on the controllable deformation material part, so as to control the controllable deformation material part to make corresponding deformation. For example, when the magnetic field control part 133 controls a magnetic field (that is, an excitation field) acted on the magnetic conductive material part 124 to make a difference, for example, a same-magnetic-pole (NN or SS) repelling magnetic field or a different-magnetic-pole (NS or SN) attraction magnetic field in certain magnetic field strength distribution is applied between neighboring display pixels shown in FIG. 1*i*, a repulsive force or an attractive force may be correspondingly generated between magnetic poles. A magnetic force passed to the flexible substrate 123 makes the flexible substrate 123 make deformation such as expansion, thereby causing that spacing between corresponding display pixels to make a difference, and achieving an objective of adjusting display pixel density distribution. The solution achieves that pixel density distribution of a display is adjustable in combination of a deformation property of a flexible substrate, for example, being scalable, and magnetic field control principles.

Figure 1J:
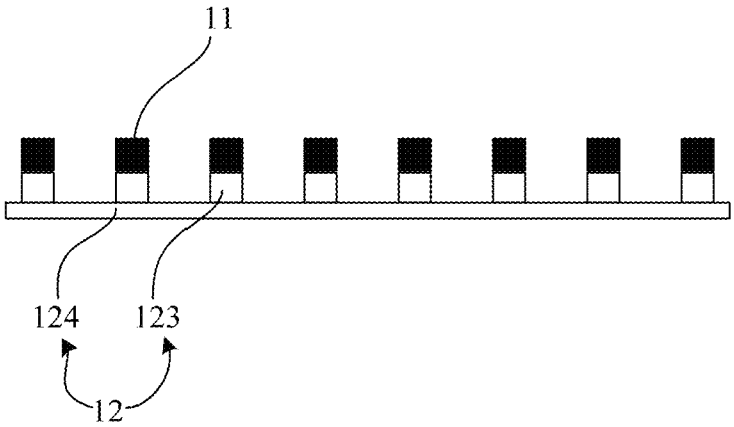
FIG. 1*j* is a schematic structural diagram of an eighth display with an adjustable pixel density, according to an embodiment of the present application.

FIG. 1*j* is a schematic structural diagram of an eighth display with an adjustable pixel density according to an embodiment of the present application. In a display shown in FIG. 1*j*, the controllable deformation material part 12 comprises: a flexible substrate 123 and multiple magnetic conductive material parts 124; a surface of the multiple magnetic conductive material parts 124 is respectively connected to the flexible substrate 123; an opposite surface of the multiple magnetic conductive material parts 124 is respectively connected to the multiple display pixels 11; the flexible substrate 123 is made to make corresponding deformation by changing a magnetic field acted on the magnetic conductive material parts 124; and density distribution of the multiple display pixels 11 is correspondingly adjusted by means of the deformation. Optionally, the magnetic conductive material part 124 is bonded to the flexible substrate 123, and the display pixels 11 is bonded to the magnetic conductive material part 124. When a magnetic field acted on the magnetic conductive material part 124 make a difference, a magnetic force passed to the flexible substrate 123 makes the flexible substrate 123 make deformation such as expansion, thereby achieving an objective of adjusting display pixel density distribution. The solution achieves that pixel density distribution of a display is adjustable in combination of a deformation property of a flexible substrate, for example, being scalable, and magnetic field control principles.

Using the technical solutions provided in the embodiments of the present application can achieve that a pixel density of a display is adjustable, and performing image display based on the display with an adjustable pixel density can fully use overall display pixels of the display to differently present display definition of different regions in an image, and improve actual usage of display pixels, which is beneficial to meeting diversified application needs of a user. The display with an adjustable pixel density may be used in a device having an image display function. For example, the display may be used in, but not limited to, the following devices such as a TV, a computer, a camera, a mobile phone, and a video recorder.

Those skilled in the art may understand that in any foregoing method in specific implementation manners of the present application, sequence numbers of steps do not mean an execution order. The execution order of the steps should be determined according to functions thereof and internal logic, and should constitute any limitation to implementation processes of the specific implementation manners of the present application.

Figure 5:
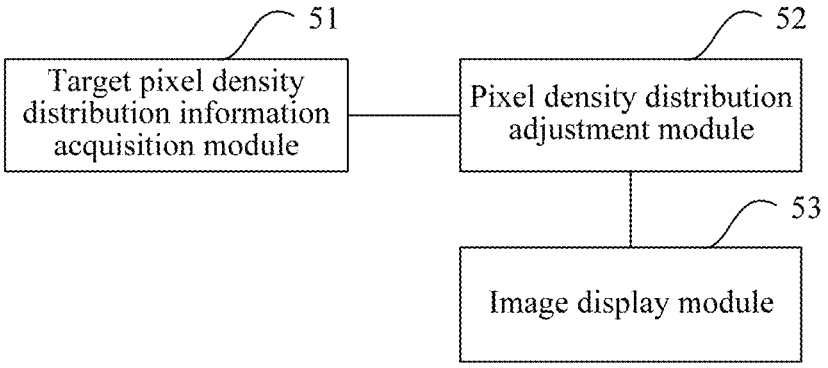
FIG. 5 is a logic block diagram of a first image display control apparatus, according to an embodiment of the present application.

FIG. 5 is a logic block diagram of a first image display control apparatus according to an embodiment of the present application. As shown in FIG. 5, the image display control apparatus according to this embodiment of the present application comprises: a target pixel density distribution information acquisition module 51, a pixel density distribution adjustment module 52, and an image display module 53.

The target pixel density distribution information acquisition module 51 acquires target pixel density distribution information displayed by an image.

The pixel density distribution adjustment module 52 adjusts display pixel density distribution of a display according to the target pixel density distribution information.

The image display module 53 displays the image according to the adjusted display.

The image display control apparatus may perform image display control by executing the image display control method in, but not limited to, an application process involving display presentation, video playback, and the like. A device expression form of the image display control apparatus is not limited, for example, the image display control apparatus may be an independent component, wherein the component is in coordinate communication with a display device comprising a display, or the image display control apparatus may be used as a certain functional module to be integrated in a display device comprising a display, wherein the display device may comprise, but is not limited to, a television, a computer, a camera, a mobile phone, a video recorder, or the like.

Performing image display control by using the image display control apparatus according to this embodiment of the present application can fully use overall pixels of the display to differently present display definition of different regions of the image. Specifically, because the display pixel density distribution of the display has been adjusted according to the target pixel density distribution information displayed by the image, in the image displayed according to the adjusted display, definition of the different regions of the actually displayed image presents different distribution corresponding to the target pixel density distribution information. The solution fully uses overall display pixels of the display, which is equivalent to performing corresponding adjustment on existing display pixel density distribution of the display according to the target pixel density distribution information to achieve an effect of displaying the image by giving the different regions different display pixel densities, causing differences between definition of the different regions of the actually displayed image, thereby meeting a need of user for differently displaying image parts. The technical solutions provided in this embodiment of the present application save the power consumption, improve actual usage of the display pixels of the display, and cost low power consumption compared with the technical solution of using a display of a high resolution to implement similar display effects on the image parts; and improve flexibility of implementation manners, may flexibly adjust the display pixel density distribution of the display according to actual needs, and better meet diversified application needs of a user compared with the solution of integrating two display regions of different resolution in one display.

Figure 6:
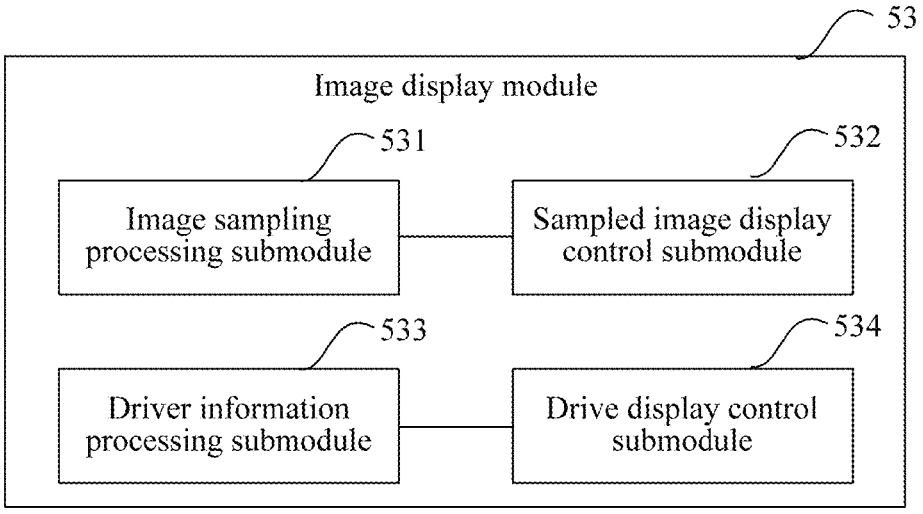
FIG. 6 is an optional logic block diagram of an image display module according to an embodiment of the present application.

Optionally, as shown in FIG. 6, the image display module 53 comprises: an image sampling processing submodule 531 and a sampled image display control submodule 532. The image sampling processing submodule 531 is configured to perform sampling processing on the image according to actual location information of a display pixel in the adjusted display. The sampled image display control submodule 532 is configured to control the adjusted display to display the image after the sampling processing. The solution may perform sampling adaptation processing on an original image to be displayed according to an actual spatial location of an adjusted display pixel, to cause achieving, based on that there are differences between the display definition of the different regions in the image, a display effect that display proportions such as sizes and shapes of the different regions in the image actually displayed by the adjusted display match display proportions such as sizes and shapes of corresponding regions in the original image, and better meeting the diversified application needs of the user.

Optionally, the image display module 53 comprises: a driver information processing submodule 533 and a drive display control submodule 534. The driver information processing submodule 533 is configured to adjust driver information of the image according to actual location information of a display pixel in the adjusted display. The drive display control submodule 534 is configured to control, according to the adjusted driver information, the adjusted display to display the image. The solution may perform drive adaptation processing on a scanning drive manner of the display according to the actual spatial location of the adjusted display pixel, to cause achieving, based on that there are differences between the display definition of the different regions in the image, a display effect that display proportions of the different regions in the image actually displayed by the adjusted display match display proportions of corresponding regions in the original image, and better meeting the diversified application needs of the user.

Figure 7:
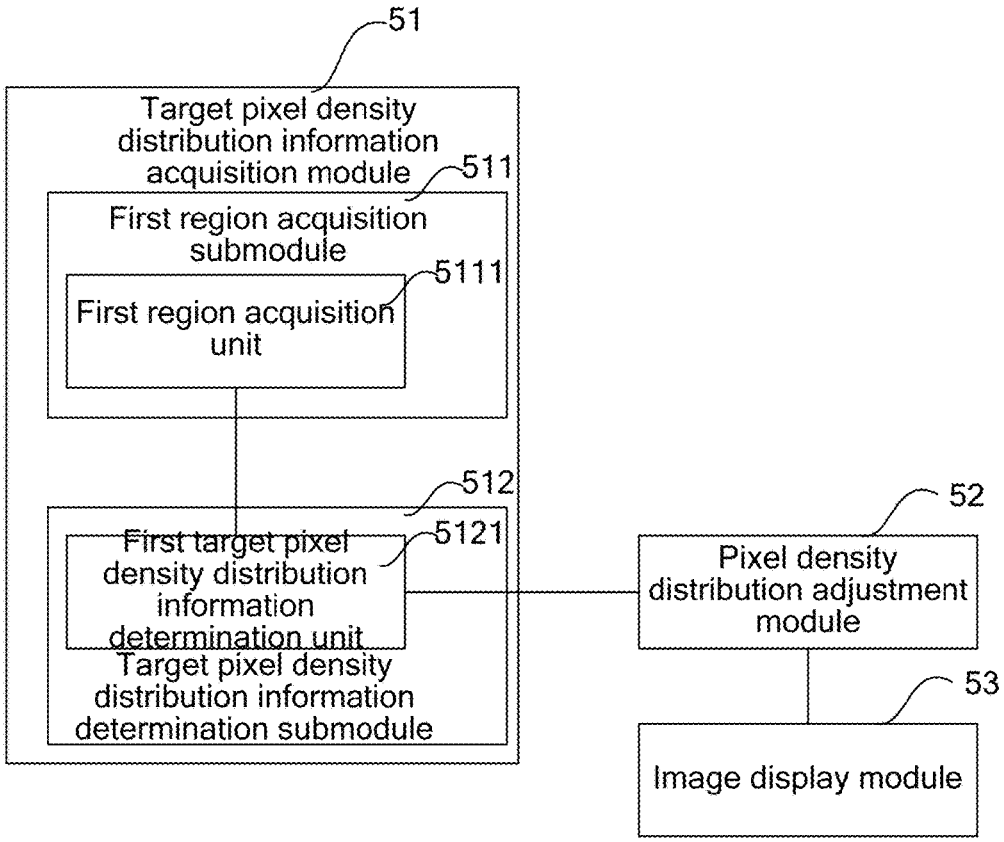
FIG. 7 is a logic block diagram of a second image display control apparatus, according to an embodiment of the present application.

Optionally, as shown in FIG. 7, the target pixel density distribution information acquisition module 51 comprises: a first region acquisition submodule 511 and a target pixel density distribution information determination submodule 512. The first region acquisition submodule 511 is configured to acquire a first region of the image. The target pixel density distribution information determination submodule 512 is configured to determine the target pixel density distribution information according to the first region, wherein in the target pixel density distribution information, a displayed target pixel density corresponding to the first region is different from a displayed target pixel density corresponding to a second region, and the second region comprises at least a partial region in the image except the first region. The first region comprises at least a partial region, whose display definition needs to be adjusted, for example, being enhanced or weakened, in the image. Specifically, in the target pixel density distribution information, the displayed target pixel density corresponding to the first region may be greater than the displayed target pixel density corresponding to the second region, or the displayed target pixel density corresponding to the first region may be less than the displayed target pixel density corresponding to the second region. The implementation manners in the foregoing solutions are very flexible, which can better meet diversified application needs of a user.

Optionally, the first region acquisition submodule 511 comprises: a first region acquisition unit 5111. The first region acquisition unit 5111 is configured to acquire one or more first subregions of the image, wherein the first region comprises the one or more first subregions. In a case in which the first region comprises the multiple first subregions, distribution of the multiple first subregions in the image may be continuous and may also be discrete. Therefore, flexibility of determination of the first region is improved.

Optionally, the target pixel density distribution information determination submodule 512 comprises: a first target pixel density distribution information determination unit 5121. The first target pixel density distribution information determination unit 5121 is configured to determine the target pixel density distribution information according to the one or more first subregions. In a case in which the first subregion is multiple, in the target pixel density distribution information, a displayed target pixel density corresponding to at least one of the first subregions is different from a displayed target pixel density corresponding to any other first subregion. The solution may perform adjustment of the same degree on display definition of the multiple first subregions in the image, to cause the display definition of the first subregions to be the same or as close as possible. Or, in the case in which the first subregion is multiple, in the target pixel density distribution information, all displayed target pixel densities respectively corresponding to the different first subregions in the target pixel density distribution information are the same. The solution may perform adjustment of different degrees on display definition of the multiple first subregions in the image, to cause that the display definition of the first subregions presents a certain degree of differentiation.

Figure 8:
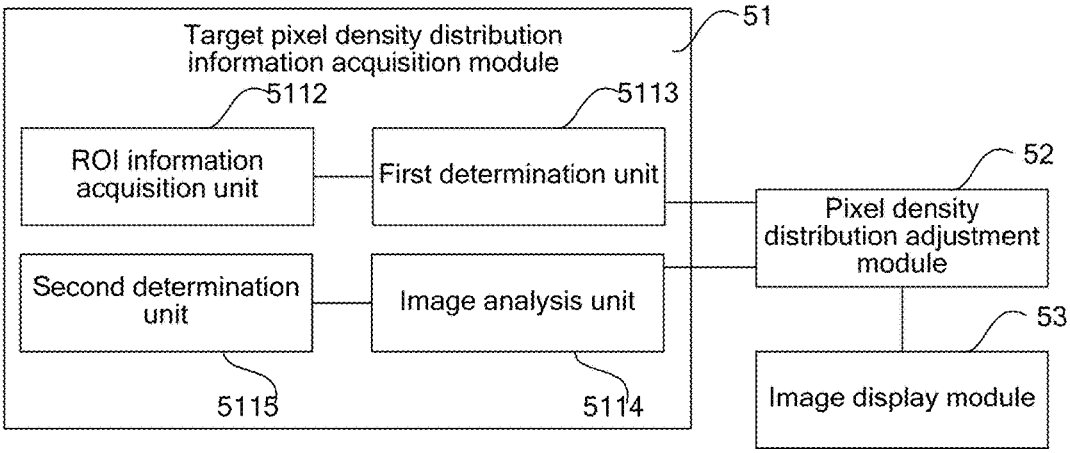
FIG. 8 is a logic block diagram of a third image display control apparatus, according to an embodiment of the present application.

Optionally, as shown in FIG. 8, the first region acquisition submodule 511 comprises: an ROI information acquisition unit and a first determination unit 5113. The ROI information acquisition unit 5112 is configured to acquire ROI information. The first determination unit 5113 is configured to determine the first region of the image according to the information of the ROI. The solution determines the first region of the image according to the ROI. The determined first region may be a region corresponding to the ROI, or the determined first region may be a region corresponding to a non-ROI, in the image, to cause that the determination of the first region fits actual user needs more, which can better meet diversified application needs of a user.

Optionally, the first region acquisition submodule 511 comprises: an image analysis unit 5114 and a second determination unit 5115. The image analysis unit 5114 is configured to perform an image analysis on the image. The second determination unit 5115 is configured to determine the first region of the image according to a result of the image analysis. The solution may determine the first region according to the image analysis result of the image to be displayed, to cause that the determination of the first region is more intelligent, and efficiency and universality of the determination of the first region are improved.

Figure 9:
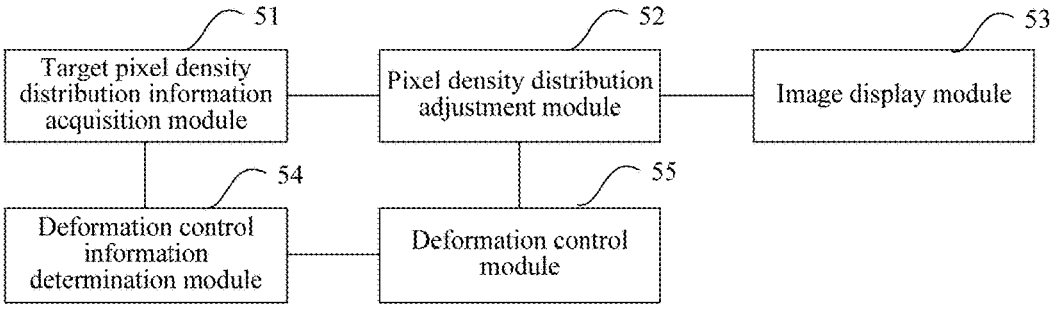
FIG. 9 is a logic block diagram of a fourth image display control apparatus, according to an embodiment of the present application.

Optionally, as shown in FIG. 9, an image display control module further comprises: a deformation control information determination module 54 and a deformation control module 55. The deformation control information determination module 54 is configured to determine deformation control information of a controllable deformation material part according to the target pixel density distribution information. The deformation control module 55 is configured to control, according to the deformation control information, the controllable deformation material part to make deformation, so as to correspondingly adjust the display pixel density distribution of the display by means of the deformation of the controllable deformation material part. The controllable deformation material part is prepared from at least one or more of the following controllable deformation materials: a piezoelectric material, an electroactive polymer (EAP), and a photo-induced deformation material. The solution may fully use a unique physical property (for example, the piezoelectric material may make mechanical deformation under an electric field; the EAP may change shapes and/or sizes thereof under the electric field; and the photo-induced deformation material may make deformation under a light field) of the controllable deformation material to achieve an objective of indirectly adjusting the pixel distribution of the display.

Figure 10:
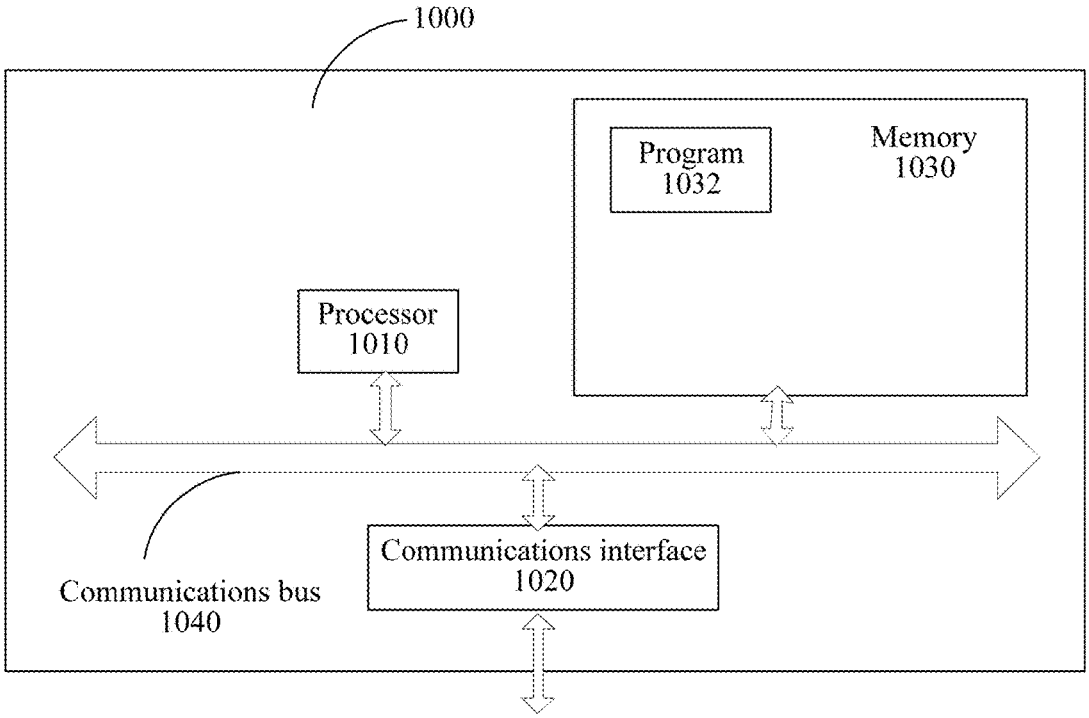
FIG. 10 is a logic block diagram of a fifth image display control apparatus, according to an embodiment of the present application.

FIG. 10 is a logic block diagram of a fifth image display control apparatus according to an embodiment of the present application, and a specific embodiment of the present application does not limit a specific implementation manner of an image display control apparatus 1000. As shown in FIG. 10, the image display control apparatus 1000 may comprise:

a processor 1010, a communications interface 1020, a memory 1030, and a communications bus 1040.

The processor 1010, the communications interface 1020, and the memory 1030 communicate with each other by using the communications bus 1040.

The communications interface 1020 is configured to communicate with a device that has a communication function, an external light source, and the like.

The processor 1010 is configured to execute a program 1032, and may specifically implement relevant steps of any foregoing image display control method embodiments.

For example, the program 1032 may comprise program code, wherein the program code comprises a computer operation instruction.

The processor 1010 may be a central processing unit (CPU), or an application specific integrated circuit (ASIC), or may be configured as one or more integrated circuits that implement the embodiments of the present application.

The memory 1030 is configured to store the program 1032. The memory 1030 may comprise a random access memory (RAM), and may also comprise a non-volatile memory such as at least one magnetic disk memory.

For example, in an optional implementation manner, the processor 1010 may perform the following steps by executing the program 1032: acquiring target pixel density distribution information displayed by an image; adjusting display pixel density distribution of a display according to the target pixel density distribution information; and displaying the image according to the adjusted display.

In another optional implementation manner, the processor 1010 may further perform any step referred by any other foregoing embodiments by executing the program 1032, which is not described herein again.

For the specific implementation of the steps in the program 1032, refer to the corresponding descriptions of corresponding steps, modules, submodules, and units in the foregoing embodiments, which are not described herein again. Those skilled in the art may clearly understand that for ease and simplicity of description, for specific working processes of the devices and modules described above, reference may be made to corresponding process description in the foregoing method embodiments, which is not described herein again.

Figure 11:
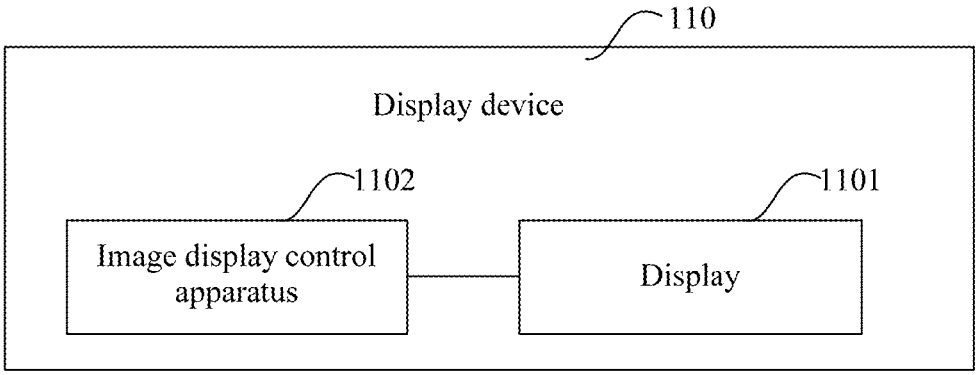
FIG. 11 is a logic block diagram of a display device, according to an embodiment of the present application.

FIG. 11 is a logic block diagram of a display device according to an embodiment of the present application. As shown in FIG. 11, a display device 110 according to this embodiment of the present application comprises a display 1101 and an image display control apparatus 1102, wherein the image display control apparatus 1102 is in a communication connection to the display 1101. For description of a structure and working principles of the image display control apparatus, reference may be made to records of corresponding embodiments described above, which is not described herein again. The display comprises a flexible substrate and multiple display pixels formed on the flexible substrate. The display device may comprise, but is not limited to, a device having an image display function such as photo taking, photographing, video recording, and video surveillance. For example, the display device may be, but is not limited to, the following devices such as a camera, a mobile phone, a pick-up head, a video camera, and a video recorder.

In the technical solutions provided in the embodiments of the present application, the image display control apparatus acquires target pixel distribution information of an image to be displayed, adjusts display pixel density distribution of a display according to the target pixel distribution information, and displays the image according to the adjusted display, to cause that in an image display process, overall display pixels of a display can be fully used to differently present display definition of different regions in an image, and actual usage of the display pixels is improved, which is beneficial to meeting diversified application needs of a user.

Optionally, the display may be selected from a flexible display with an adjustable pixel density, or the display may also be selected from another structure with an adjustable pixel density. For example, the display comprises: multiple display pixels in array distribution and a controllable deformation material part separately connected to the multiple display pixels, wherein the controllable deformation material part may make deformation under an external field and correspondingly adjust density distribution of the multiple display pixels by means of the deformation, and the external field is controlled by the image display control apparatus. For a structure of the display, reference may be made to corresponding records of FIG. 1*b* to FIG. 1*j*. The image display control apparatus may directly control the external field to control the deformation of the controllable deformation material part, and further adjust the display pixel density distribution of the display; or the image display control apparatus may indirectly control the external field by controlling the deformation control part, to cause that a controllable deformation material part to which the deformation control part belongs makes corresponding deformation to correspondingly adjust the display pixel density distribution of the display; or the like. A physical connection manner of the display pixels and the deformation material part may be determined according to actual needs, as long as it is met that the display pixel density distribution of the display can be adjusted when the deformation material part makes deformation, which is not limited in this embodiment of the present application. For specific implementation manners, reference may be made to the foregoing corresponding records, which are not described herein again.

In the embodiments of the present application, sequence numbers and/or sequential orders of the embodiments are just for ease of description and do not represent the superiority or inferiority of the embodiments. Description of each embodiment has particular emphasis, and for the part, not described in detail, of a certain embodiment, reference may be made to related description in other embodiments. For related description with respect to implementation principles or processes of apparatus, device or system embodiments, reference may be made to a record of a corresponding method embodiment, which is not described herein again.

It can be appreciated by those skilled in the art that each exemplary unit and method step described with reference to the embodiments disclosed in this text can be realized by electronic hardware or a combination of computer software and electronic hardware. Whether these functions are executed in a hardware mode or a software mode depends on the specific applications and design constraint conditions of the technical solution. The professional technicians can use different methods to realize the functions described with respect to each specific application, but this realization should not be considered to go beyond the scope of the present application.

If said function is realized in the form of a software functional unit and is sold or used as an independent product, it can be stored in a computer-readable storage medium. Based on such understanding, the technical solution of the present application essentially or the part which contributes to the prior art or a part of the technical solution can be embodied in the form of a software product, and the computer software product is stored in a storage medium, and comprises several instructions for enabling a computer apparatus (which can be a personal computer, a server, or a network apparatus, etc.) to execute all or some steps of the method described in each embodiment of the present application. The preceding storage medium comprises various media which can store a program code, such as a USB disk, a mobile hard disk, a read-only memory (ROM), a random access memory (RAM), a magnetic disk or a compact disk, etc.

In the embodiments of the apparatus, the method, the system, and the like in the present application, obviously, components (a system, a subsystem, a module, a submodule, a unit, a subunit, and the like) or steps may be decomposed, combined, and recombined after being decomposed. The decomposition and/or recombination should be regarded as equivalent solutions of the present application. Meanwhile, in the foregoing description of the specific embodiments of the present application, a feature described and/or illustrated regarding an implementation manner may be used in one or more other implementation manners in the same or a similar manner, may be combined with a feature of the other implementation manners, or may replace a feature of the other implementation manners.

It should be emphasized that terms "comprise/contain" used in this text refer to existence of a feature, an element, a step, or a component, but existence or addition of one or more other features, elements, elements, steps, or components is not excluded.

The above implementations are only used to describe the present application, without limiting the present application; various alterations and variants can be made by those skilled in the related art without departing from the spirit and scope of the present application, so all equivalent technical solutions also belong to the scope of the present application, and the scope of patent protection of the present application should be defined by claims.

What is claimed is:

1. An image display control method, comprising:

acquiring target pixel density distribution information displayed by an image;

determining deformation control information of a controllable deformation material part according to the target pixel density distribution information;

controlling, according to the deformation control information, the controllable deformation material part to make a deformation, so as to correspondingly adjust a display pixel density distribution of the display by the deformation of the controllable deformation material part; and displaying the image according to the adjusted display.

2. The method of claim 1, wherein the displaying the image according to the adjusted display comprises:

performing sampling processing on the image according to actual location information of a display pixel in the adjusted display; and controlling the adjusted display to display the image after the sampling processing.

3. The method of claim 1, wherein the displaying the image according to the adjusted display comprises:

adjusting driver information of the image according to actual location information of a display pixel in the adjusted display; and controlling, according to the adjusted driver information, the adjusted display to display the image.

4. The method of claim 1, wherein the acquiring target pixel density distribution information displayed by an image comprises:

acquiring a first region of the image; and determining the target pixel density distribution information according to the first region, wherein in the target pixel density distribution information, a displayed target pixel density corresponding to the first region is different from a displayed target pixel density corresponding to a second region, and the second region comprises at least a partial region in the image except the first region.

5. The method of claim 4, wherein the first region comprises one or more first subregions.

6. The method of claim 5, wherein all displayed target pixel densities respectively corresponding to the different first subregions in the target pixel density distribution information are the same.

7. The method of claim 5, wherein in the target pixel density distribution information, a displayed target pixel density corresponding to at least one of the first subregions is different from a displayed target pixel density corresponding to any other first subregion.

8. The method of claim 4, wherein in the target pixel density distribution information, the displayed target pixel density corresponding to the first region is greater than the displayed target pixel density corresponding to the second region.

9. The method of claim 4, wherein in the target pixel density distribution information, the displayed target pixel density corresponding to the first region is less than the displayed target pixel density corresponding to the second region.

10. The method of claim 4, wherein the acquiring a first region of the image comprises:

acquiring information of a region of interest (ROI); and determining the first region of the image according to the information of the ROI.

11. The method of claim 4, wherein the acquiring a first region of the image comprises:

performing an image analysis on the image; and determining the first region of the image according to a result of the image analysis.

12. The method of claim 1, wherein the controllable deformation material part is prepared from at least one or more of the following controllable deformation materials: a piezoelectric material, an electroactive polymer (EAP), a photo-induced deformation material, and a magnetostrictive material.

13. An image display control apparatus, comprising:

a target pixel density distribution information acquisition module, configured to acquire target pixel density distribution information displayed by an image;

a deformation control information determination module, configured to determine deformation control information of a controllable deformation material part according to the target pixel density distribution information;

a deformation control module, configured to control, according to the deformation control information, the controllable deformation material part to make a deformation, so as to correspondingly adjust a display pixel density distribution of the display by the deformation of the controllable deformation material part; and an image display module, configured to display the image according to the adjusted display.

14. The apparatus of claim 13, wherein the image display module comprises:

an image sampling processing submodule, configured to perform sampling processing on the image according to actual location information of a display pixel in the adjusted display; and a sampled image display control submodule, configured to control the adjusted display to display the image after the sampling processing.

15. The apparatus of claim 13, wherein the image display module comprises:

a driver information processing submodule, configured to adjust driver information of the image according to actual location information of a display pixel in the adjusted display; and a drive display control submodule, configured to control, according to the adjusted driver information, the adjusted display to display the image.

16. The apparatus of claim 13, wherein the target pixel density distribution information acquisition module comprises:

a first region acquisition submodule, configured to acquire a first region of the image; and a target pixel density distribution information determination submodule, configured to determine the target pixel density distribution information according to the first region, wherein in the target pixel density distribution information, a displayed target pixel density corresponding to the first region is different from a displayed target pixel density corresponding to a second region, and the second region comprises at least a partial region in the image except the first region.

17. The apparatus of claim 16, wherein the first region acquisition submodule comprises:

a first region acquisition unit, configured to acquire one or more first subregions of the image, wherein the first region comprises the one or more first subregions.

18. The apparatus of claim 17, wherein the target pixel density distribution information determination submodule comprises:

a first target pixel density distribution information determination unit, configured to determine the target pixel density distribution information according to the one or more first subregions, wherein in a case in which the first subregion is multiple, in the target pixel density distribution information, a displayed target pixel density corresponding to at least one of the first subregions is different from a displayed target pixel density corresponding to any other first subregion, or all displayed target pixel densities respectively corresponding to the different first subregions in the target pixel density distribution information are the same.

19. The apparatus of claim 16, wherein the first region acquisition submodule comprises:

a region of interest (ROI) information acquisition unit, configured to acquire ROI information; and a first determination unit, configured to determine the first region of the image according to the information of the ROI.

20. The apparatus of claim 16, wherein the first region acquisition submodule comprises:

an image analysis unit, configured to perform an image analysis on the image; and a second determination unit, configured to determine the first region of the image according to a result of the image analysis.

21. A display device, comprising a display and an image display control apparatus of claim 13, wherein the image display control apparatus is in a communication connection to the display.

22. The display device of claim 21, wherein the display device comprises:

multiple display pixels in array distribution; and a controllable deformation material part separately connected to the multiple display pixels, wherein the controllable deformation material part may make deformation under an external field and correspondingly adjust density distribution of the multiple display pixels by means of the deformation, and the external field is controlled by the image display control apparatus.

23. A computer readable non-transitory storage apparatus, comprising at least one executable instruction, which, in response to execution, causes an image display control apparatus comprising a processor to perform operations, comprising:

acquiring target pixel density distribution information displayed by an image;

determining deformation control information of a controllable deformation material part according to the target pixel density distribution information;

controlling, according to the deformation control information, the controllable deformation material part to make a deformation, so as to correspondingly adjust the display pixel density distribution of a display by the deformation of the controllable deformation material part; and displaying the image according to the adjusted display.

24. An image display control apparatus, characterized by comprising a processor and a memory, the memory storing computer executable instructions, the processor being connected to the memory through a communication bus, and when the apparatus for controlling task migration operates, the processor executing the computer executable instructions stored in the memory, so that the apparatus for controlling task migration executes operations, comprising:

acquiring target pixel density distribution information displayed by an image;

determining deformation control information of a controllable deformation material part according to the target pixel density distribution information;

controlling, according to the deformation control information, the controllable deformation material part to make a deformation, so as to correspondingly adjust a display pixel density distribution of the display by the deformation of the controllable deformation material part; and displaying the image according to the adjusted display.

* * * * *